US009339923B2

(12) United States Patent
Aoki

(10) Patent No.: US 9,339,923 B2
(45) Date of Patent: May 17, 2016

(54) POWER TOOL

(75) Inventor: Yonosuke Aoki, Anjo (JP)

(73) Assignee: MAKITA CORPORATION, Anjo-shi (JP)

( * ) Notice: Subject to any disclaimer, the term of this patent is extended or adjusted under 35 U.S.C. 154(b) by 943 days.

(21) Appl. No.: 13/505,034

(22) PCT Filed: Oct. 20, 2010

(86) PCT No.: PCT/JP2010/068481

§ 371 (c)(1),
(2), (4) Date: Jun. 26, 2012

(87) PCT Pub. No.: WO2011/052449

PCT Pub. Date: May 5, 2011

(65) Prior Publication Data

US 2012/0261150 A1 Oct. 18, 2012

(30) Foreign Application Priority Data

Nov. 2, 2009 (JP) ..... 2009-251927

(51) Int. Cl.
*B25D 15/00* (2006.01)
*B25D 16/00* (2006.01)

(52) U.S. Cl.
CPC ..... *B25D 16/003* (2013.01); *B25D 16/006* (2013.01); *B25D 2211/068* (2013.01); *B25D 2216/0015* (2013.01);
(Continued)

(58) Field of Classification Search
CPC ..... B25D 16/003; B25D 16/006; B25D 2250/165; B25D 2216/0015; B25D 2216/0023; B25D 2250/145
USPC ..... 173/5, 48, 104, 111, 114, 178
See application file for complete search history.

(56) References Cited

U.S. PATENT DOCUMENTS 3,828,863 A * 8/1974 Bleicher et al. ..... 173/48
3,874,460 A * 4/1975 Schmid et al. ..... 173/109
(Continued)

FOREIGN PATENT DOCUMENTS

GB 1315904 A 5/1973
JP A-2002-224975 8/2002

OTHER PUBLICATIONS

Oct. 24, 2014 Office Action issued in Russian Application No. 2012122780/02(034628).
(Continued)

*Primary Examiner* — Michelle Lopez
*Assistant Examiner* — Eduardo R Ferrero
(74) *Attorney, Agent, or Firm* — Oliff PLC

(57) ABSTRACT

Disclosed is a striking tool technology that contributes to reducing clutch sizes. The striking tool causes a tool bit to perform a striking operation in the long axis direction and to perform a rotational operation about the long axis, thereby causing the tool bit to carry out a predetermined machining operation. The striking tool comprises a tool body; a motor which is housed in the tool body and drives the tool bit; and a clutch which, on a route where the torque of the motor is transmitted to the tool bit, is disposed in a high rotational speed and low torque region that is a stage prior to where the rotational speed of the motor is reduced, which transmits the torque of the motor to the tool bit in a normal state, and which cuts off the transmission of torque generated about the tool bit long axis in the tool body if the torque exceeds a predetermined torque level.

2 Claims, 6 Drawing Sheets

(52) U.S. Cl.
CPC ..... *B25D 2216/0023* (2013.01); *B25D 2216/0069* (2013.01); *B25D 2250/145* (2013.01); *B25D 2250/165* (2013.01); *B25D 2250/255* (2013.01)

(56) References Cited

U.S. PATENT DOCUMENTS

| | | | | |
|---|---|---|---|---|
| 4,349,074 | A * | 9/1982 | Ince | 173/48 |
| 4,365,962 | A * | 12/1982 | Regelsberger | 464/39 |
| 4,529,044 | A * | 7/1985 | Klueber et al. | 173/48 |
| 4,825,992 | A * | 5/1989 | Skrobisch | 192/56.4 |
| 4,967,888 | A * | 11/1990 | Lippacher et al. | 192/56.5 |
| 5,277,259 | A * | 1/1994 | Schmid et al. | 173/13 |
| 5,631,511 | A * | 5/1997 | Schulmann et al. | 310/83 |
| 5,879,111 | A * | 3/1999 | Stock et al. | 408/6 |
| 5,996,707 | A * | 12/1999 | Thome et al. | 173/2 |
| 7,766,096 | B2 * | 8/2010 | Satou et al. | 173/162.2 |
| 2001/0042630 | A1 * | 11/2001 | Kristen et al. | 173/1 |
| 2001/0052417 | A1 * | 12/2001 | Neumaier | 173/48 |
| 2002/0062967 | A1 * | 5/2002 | Ziegler | 173/216 |
| 2002/0066632 | A1 * | 6/2002 | Kristen et al. | 192/17 C |
| 2005/0263306 | A1 * | 12/2005 | Frauhammer et al. | 173/48 |
| 2006/0086514 | A1 * | 4/2006 | Aeberhard | 173/48 |
| 2006/0124331 | A1 * | 6/2006 | Stirm et al. | 173/178 |
| 2006/0207775 | A1 * | 9/2006 | Armstrong | 173/1 |
| 2007/0289759 | A1 * | 12/2007 | Hartmann et al. | 173/48 |
| 2008/0210451 | A1 * | 9/2008 | Aoki | 173/211 |
| 2009/0014195 | A1 * | 1/2009 | Lauterwald | 173/104 |
| 2009/0126954 | A1 * | 5/2009 | Trautner | 173/48 |
| 2009/0223693 | A1 * | 9/2009 | Aoki | 173/211 |
| 2009/0266572 | A1 * | 10/2009 | Meixner et al. | 173/205 |
| 2010/0038104 | A1 * | 2/2010 | Baumann et al. | 173/162.1 |
| 2012/0186842 | A1 | 7/2012 | Wiedemann et al. | |

OTHER PUBLICATIONS

Feb. 1, 2011 International Search Report issued in International Patent Application No. PCT/JP2010/068481 (with translation).

Jun. 21, 2012 International Preliminary Report on Patentability issued in International Patent Application No. PCT/JP2010/068481; with English-language translation.

Jun. 5, 2015 Search Report issued in European Application No. 10826581.0.

* cited by examiner

POWER TOOL

FIELD OF THE INVENTION

The present invention relates to an impact power tool which is capable of preventing excessive reaction torque from acting on a tool body when a tool bit is unintentionally locked.

BACKGROUND OF THE INVENTION

U.S. Patent Publication No. 2007-0289759 discloses a hammer drill having a clutch which is disposed in a power transmitting mechanism for transmitting torque of a motor to a tool bit and capable of interrupting torque transmission from the motor to the tool bit when the hammer bit is unintentionally locked during hammer drill operation and thereby preventing reaction torque or excessive torque from acting on a tool body in a direction opposite to the direction of rotation of the tool bit.

In the above-described known technique for preventing reaction torque, the clutch is disposed in the power transmitting mechanism in which the rotation speed of the motor is reduced. Therefore, the size of the clutch is increased in order to allow transmission of high torque. In this point, further improvement is required.

DISCLOSURE OF THE INVENTION

Problems to be Solved by the Invention

Accordingly, it is an object of the present invention to provide an impact tool that contributes to size reduction of a clutch.

Means for Solving the Problems

In order to solve the above-described problem, according to a preferred embodiment of the present invention, an impact tool is provided which causes a tool bit to perform striking movement in its axial direction and rotation around its axis and thereby causes the tool bit to perform a predetermined operation on a workpiece.

The impact tool according to the preferred embodiment of the present invention includes a tool body, a motor that is housed in the tool body and drives the tool bit, a clutch that is disposed in a high-speed low-torque region located at a stage prior to reduction of rotation speed of the motor in a path of transmitting torque of the motor to the tool bit, and normally transmits torque of the motor to the tool bit, while interrupting the torque transmission when the torque acting on the tool body around an axis of the tool bit exceeds a predetermined torque.

The "torque acting on the tool body around an axis of the tool bit" refers to reaction torque which acts on the tool body in a direction opposite to the direction of rotation of the tool bit during operation. Further, the "predetermined torque" acting on the tool body can be recognized by using a method of measuring torque values of a shaft rotating together with the tool bit in the power transmitting path, via a torque sensor and determining from the measurement whether the torque exceeds the predetermined torque, or by using a method of measuring momentum of the tool body around an axis of the tool bit via a speed sensor or an acceleration sensor and determining from the measurements whether the torque exceeds the predetermined torque value.

According to this invention having the above-described construction, when the tool bit is unintentionally locked during operation such as drilling on a workpiece, the clutch can interrupt torque transmission between the motor and the tool bit and thereby prevent excessive reaction torque from acting on the tool body. Particularly, according to this invention, with the construction in which the clutch is disposed in a high-speed low-torque region located at a stage prior to reduction of rotation speed of the motor, torque acting on the clutch is reduced, so that the clutch can be reduced in size and weight.

According to a further embodiment of the present invention, in the path of transmitting torque of the motor to the tool bit, the impact tool includes a motor output shaft, a power transmitting shaft which is disposed downstream of the motor output shaft and reduces the speed of rotation of the motor output shaft and transmits the rotation to the tool bit, and a clutch shaft disposed between the motor output shaft and the power transmitting shaft. Further, the clutch is disposed on the clutch shaft.

According to this invention, when the tool bit is unintentionally locked during operation such as drilling on a workpiece, the clutch can interrupt torque transmission between the motor and the tool bit and thereby prevent excessive reaction torque from acting on the tool body. Particularly, according to this invention, the clutch shaft is disposed between the motor output shaft and the power transmitting shaft which reduces the speed of rotation of the motor output shaft and transmits the rotation, and the clutch is disposed on the clutch shaft. Specifically, in this invention, a shaft specifically designed for mounting the clutch is provided. With such a construction, the degree of freedom in designing the clutch increases, and the clutch can be driven at high speed and low torque. Thus, torque acting on the clutch is reduced, so that the clutch can be reduced in size and weight.

According to a further embodiment of the present invention, the speed ratio between the motor output shaft and the clutch shaft is smaller than the speed reducing ratio between the clutch shaft and the power transmitting shaft.

According to this invention, the speed ratio between the motor output shaft and the clutch shaft can be arbitrarily selected to equal, decrease or increase the speed.

According to a further embodiment of the present invention, the impact tool further includes a striking element that is rectilinearly driven by the motor in the axial direction of the tool bit and strikes the tool bit in the axial direction. Further, the clutch is disposed closer to an axis of striking movement of the striking element than a power transmitting region between the clutch shaft and the power transmitting shaft. The "power transmitting region" typically refers to a power transmitting region for transmitting power by engagement between gears on the shafts.

According to this invention, with the construction in which the clutch is disposed closer to the axis of striking movement of the striking element, moment (vibration) which is caused in the striking direction around the center of gravity of the impact tool during striking movement of the tool bit can be effectively reduced.

According to a further embodiment of the present invention, the clutch includes a driving-side clutch part and a driven-side clutch part, and transmits torque by contact of the clutch parts while interrupting the torque transmission by disengagement of the clutch parts. Further, the clutch shaft includes a driving-side clutch shaft formed on the driving-side clutch part and a driven-side clutch shaft formed on the driven-side clutch part, and the clutch shafts are coaxially disposed radially inward and outward.

According to this invention, clutch faces (power transmitting faces) of the clutch can be provided on the same shaft end region. Specifically, input and output can be made on the same shaft end region, so that the clutch can be disposed closer to the axis of striking movement. Further, the clutch can be reduced in size in its axial direction, so that rational space-saving arrangement can be realized.

According to a further embodiment of the present invention, in the path of transmitting torque of the motor to the tool bit, the impact tool includes an impact drive mechanism for driving the tool bit by impact, a rotary drive mechanism for rotationally driving the tool bit, an impact drive shaft that is rotationally driven by the motor and normally drives the impact drive mechanism, and a rotary drive shaft that is rotationally driven independently of the impact drive shaft by the motor and drives the rotary drive mechanism. Further, the impact drive shaft and the rotary drive shaft are coaxially disposed, and the clutch is disposed on the rotary drive shaft.

According to this invention, when the tool bit is unintentionally locked during operation such as drilling on a workpiece, the clutch can interrupt torque transmission between the motor and the rotary drive mechanism and thereby prevent excessive reaction torque from acting on the tool body. Particularly, according to this invention, with the construction in which the clutch is disposed on the rotary drive shaft which is driven at high speed and low torque of the motor, torque acting on the clutch is reduced and the clutch can be reduced in size and weight.

According to a further embodiment of the present invention, in the impact tool in which the impact drive shaft and the rotary drive shaft are coaxially disposed and the clutch is disposed on the rotary drive shaft, the impact drive shaft is located radially inward and the rotary drive shaft is located radially outward. According to this invention, size reduction in the axial direction can be realized, so that rational space-saving arrangement can be achieved.

According to a further embodiment of the present invention, the clutch is designed and provided as an electromagnetic clutch including a driving-side clutch part, a driven-side clutch part, a biasing member that biases the clutch parts away from each other so as to interrupt transmission of torque, and an electromagnetic coil that brings the clutch parts into contact with each other against the biasing force of the biasing member and thereby transmits torque when the electromagnetic coil is energized.

According to this invention, by utilizing the electromagnetic clutch as a clutch for preventing excessive reaction torque from acting on the tool body, the clutch can be made easy to control and reduced in size.

According to a further embodiment of the present invention, torque transmission between shafts in the torque transmission path of transmitting torque from the motor to the tool bit is made by a gear, and the gear is housed in a gear chamber in which a lubricant is sealed. Further, the clutch is isolated from the gear chamber. According to this invention, with the construction in which the clutch is isolated from the gear chamber or from the lubricant, an occurrence of slippage by the lubricant can be avoided. Therefore, a friction clutch having a high reaction rate can be used as the clutch.

According to a further embodiment of the present invention, components of an impact drive mechanism that is driven by the motor and drives the tool bit by impact and components of a rotary drive mechanism that is driven by the motor and rotationally drives the tool bit are provided independently of each other.

Effect of the Invention

According to this invention, an impact tool is provided which contributes to size reduction of a clutch. Other objects, features and advantages of the present invention will be readily understood after reading the following detailed description together with the accompanying drawings and the claims.

REPRESENTATIVE EMBODIMENT OF THE INVENTION

Each of the additional features and method steps disclosed above and below may be utilized separately or in conjunction with other features and method steps to provide and manufacture improved impact tools and methods for using such impact tools and devices utilized therein. Representative examples of the present invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

First Embodiment

Figure 1:
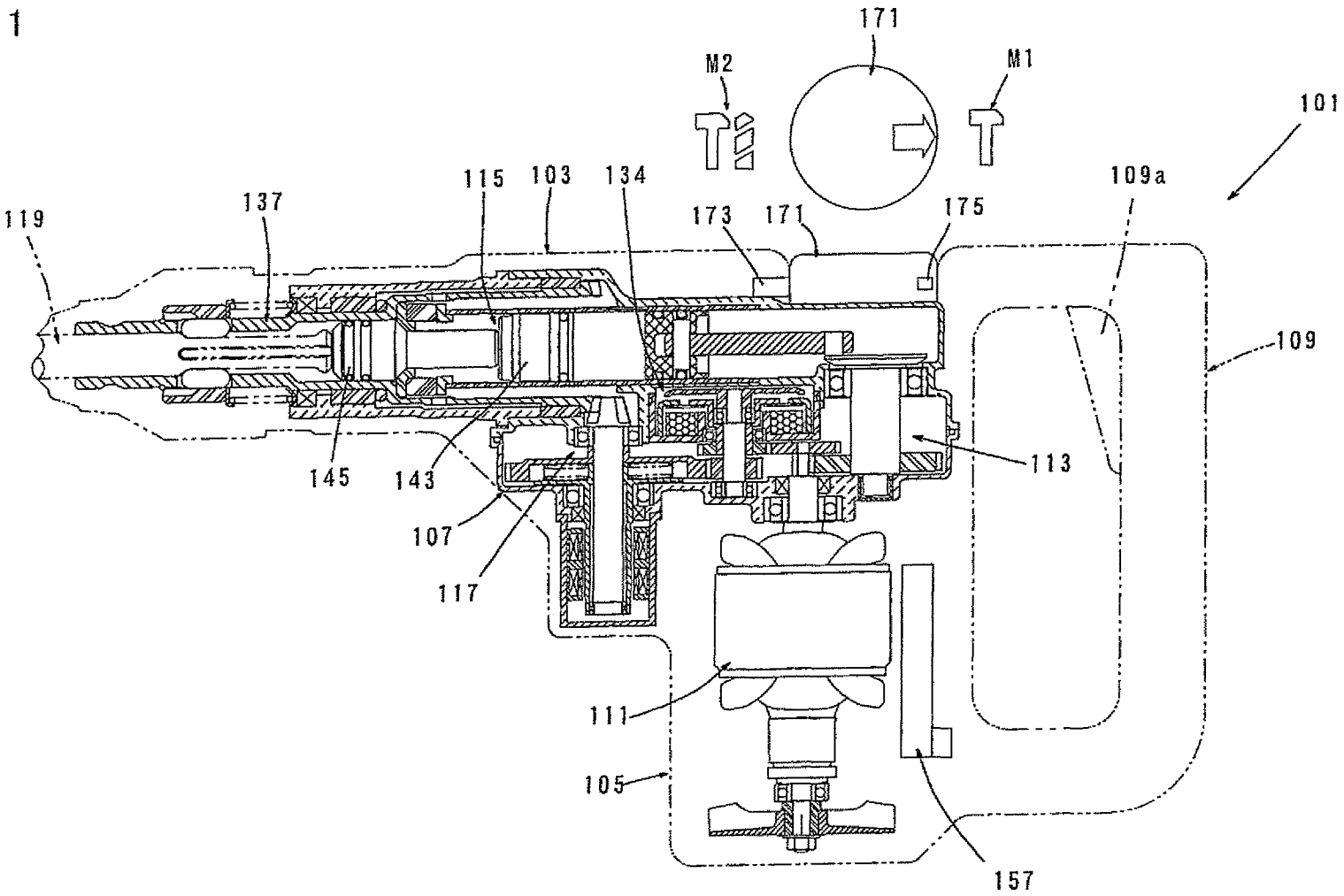
FIG. 1 is a sectional side view showing an entire structure of a hammer drill according to a first embodiment of the present invention, in a torque transmission interrupted state of a clutch.
Figure 2:
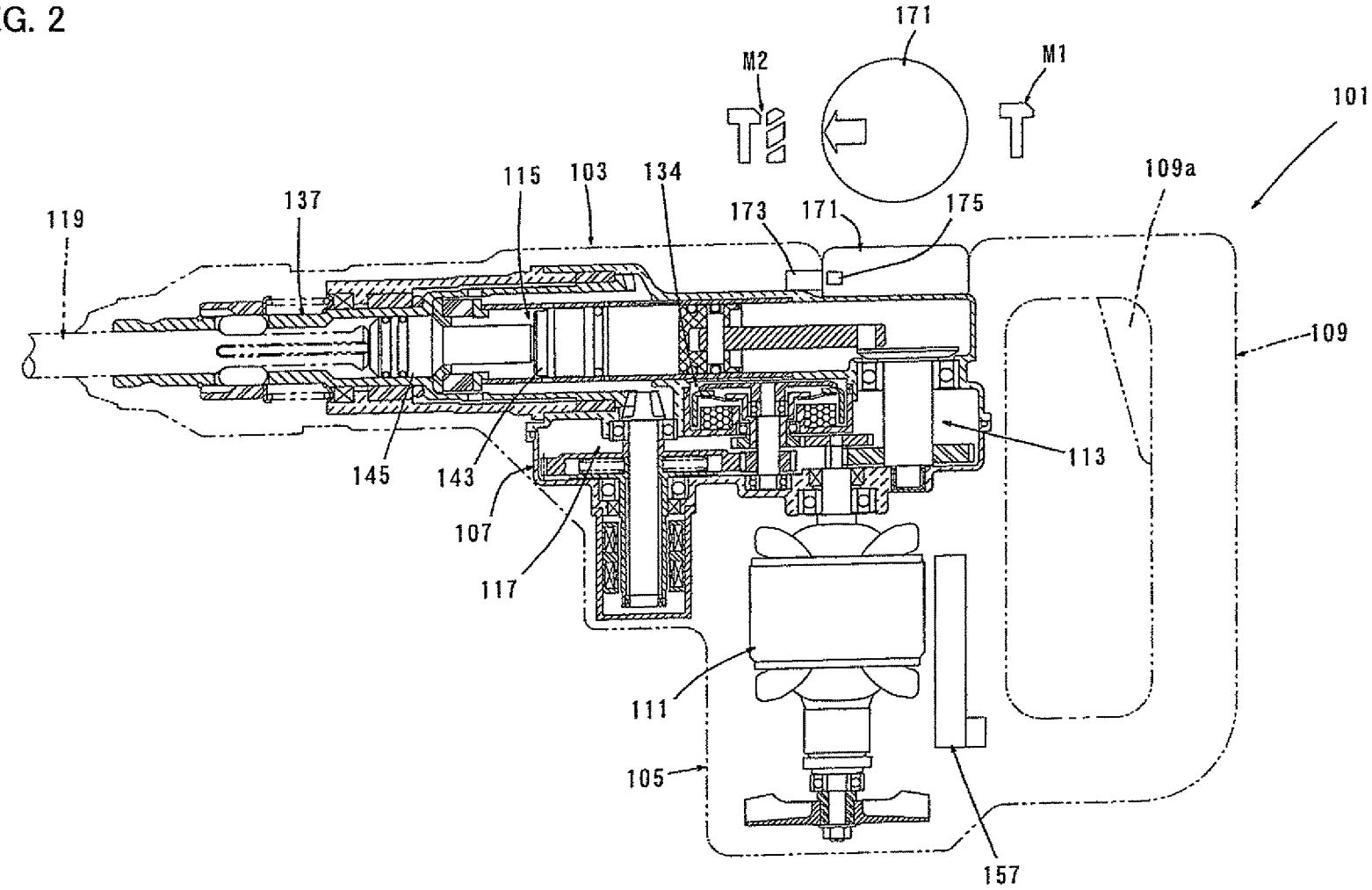
FIG. 2 is also a sectional side view showing the entire structure of the hammer drill, in a torque transmission state of the clutch.

A first embodiment of the present invention is now described with reference to FIGS. 1 to 5. The first embodiment corresponds to claim 1 of the invention. In this embodiment, an electric hammer drill is explained as a representative example of the impact tool. As shown in FIGS. 1 and 2, the hammer drill 101 according to this embodiment mainly includes a body 103 that forms an outer shell of the hammer drill 101, a hammer bit 119 detachably coupled to a front end region (on the left as viewed in FIG. 1) of the body 103 via a hollow tool holder 137, and a handgrip 109 designed to be held by a user and connected to the body 103 on the side opposite to the hammer bit 119. The hammer bit 119 is held by the tool holder 137 such that it is allowed to linearly move with respect to the tool holder in its axial direction. The body 103 and the hammer bit 119 are features that correspond to the "tool body" and the "tool bit", respectively, according to the present invention. In this embodiment, for the sake of convenience of explanation, the side of the hammer bit 119 is taken as the front and the side of the handgrip 109 as the rear.

The body 103 includes a motor housing 105 that houses a driving motor 111, and a gear housing 107 that houses a motion converting mechanism 113, a striking mechanism 115 and a power transmitting mechanism 117. The driving motor 111 is arranged such that its rotation axis runs in a vertical direction (vertically as viewed in FIG. 1) substantially perpendicular to a longitudinal direction of the body 103 (the axial direction of the hammer bit 119). The motion converting mechanism 113 appropriately converts torque (rotating output) of the driving motor 111 into linear motion and then transmits it to the striking mechanism 115. Then, an impact force is generated in the axial direction of the hammer bit 119 (the horizontal direction as viewed in FIG. 1) via the striking mechanism 115. The driving motor 111 is a feature that corresponds to the "motor" according to this invention. The motion converting mechanism 113 and the striking mechanism 115 are features that correspond to the "impact drive mechanism" according to this invention.

Further, the power transmitting mechanism 117 appropriately reduces the rotational speed outputted by the driving motor 111 and transmits the reduced rotational speed to the hammer bit 119 via the tool holder 137, so that the hammer bit 119 is caused to rotate in its circumferential direction. The driving motor 111 is driven when a user depresses a trigger 109*a* disposed on the handgrip 109. The power transmitting mechanism 117 is a feature that corresponds to the "rotary drive mechanism" according to this invention.

Figure 3:
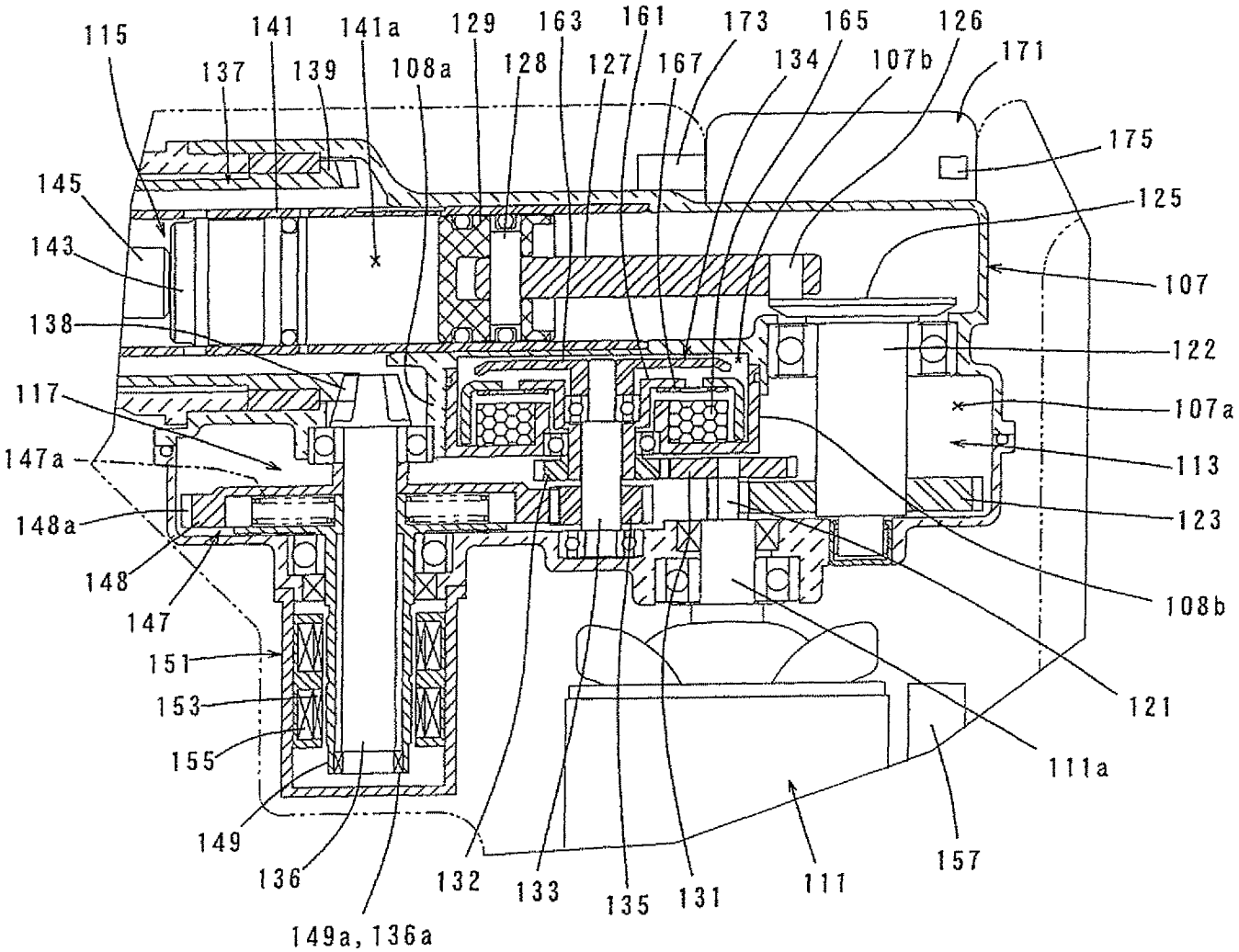
FIG. 3 is an enlarged sectional view showing an essential part of the hammer drill.

As shown in FIG. 3, the motion converting mechanism 113 mainly includes a first driving gear 121 that is formed on an output shaft (rotating shaft) 111*a* of the driving motor 111 and caused to rotate in a horizontal plane, a driven gear 123 that engages with the first driving gear 121, a crank shaft 122 to which the driven gear 123 is fixed, a crank plate 125 that is caused to rotate in a horizontal plane together with the crank shaft 122, a crank arm 127 that is loosely connected to the crank plate 125 via an eccentric shaft 126, and a driving element in the form of a piston 129 which is mounted to the crank arm 127 via a connecting shaft 128. The output shaft 111*a* of the driving motor 111 and the crank shaft 122 are disposed side by side in parallel to each other. The crank shaft 122, the crank plate 125, the eccentric shaft 126, the crank arm 127 and the piston 129 form a crank mechanism. The piston 129 is slidably disposed within a cylinder 141. When the driving motor 111 is driven, the piston 129 is caused to linearly move in the axial direction of the hammer bit 119 along the cylinder 141.

The striking mechanism 115 mainly includes a striking element in the form of a striker 143 slidably disposed within the bore of the cylinder 141, and an intermediate element in the form of an impact bolt 145 that is slidably disposed within the tool holder 137 and serves to transmit kinetic energy of the striker 143 to the hammer bit 119. An air chamber 141*a* is formed between the piston 129 and the striker 143 in the cylinder 141. The striker 143 is driven via pressure fluctuations (air spring action) of the air chamber 141*a* of the cylinder 141 by sliding movement of the piston 129. The striker 143 then collides with (strikes) the impact bolt 145 which is slidably disposed in the tool holder 137. As a result, a striking force caused by the collision is transmitted to the hammer bit 119 via the impact bolt 145. Specifically, the motion converting mechanism 113 and the striking mechanism 115 for driving the hammer bit 119 by impact are directly connected to the driving motor 111.

The power transmitting mechanism 117 mainly includes a second driving gear 131, a first intermediate gear 132, a first intermediate shaft 133, an electromagnetic clutch 134, a second intermediate gear 135, a mechanical torque limiter 147, a second intermediate shaft 136, a small bevel gear 138, a large bevel gear 139 and the tool holder 137. The power transmitting mechanism 117 transmits torque of the driving motor 111 to the hammer bit 119. The second driving gear 131 is fixed to the output shaft 111*a* of the driving motor 111 and caused to rotate in the horizontal plane together with the first driving gear 121. The first and second intermediate shafts 133, 136 are located downstream from the output shaft 111*a* in terms of torque transmission and disposed side by side in parallel to the output shaft 111*a*. The first intermediate shaft 133 is provided as a shaft for mounting the clutch and disposed between the output shaft 111*a* and the second intermediate shaft 136. The first intermediate shaft 133 is rotated via the electromagnetic clutch 134 by the first intermediate gear 132 which is constantly engaged with the second driving gear 131. The speed ratio of the first intermediate gear 132 to the second driving gear 131 is set to be almost the same. The second intermediate shaft 136 and the output shaft 111*a* of the driving motor 111 are features that correspond to the "power transmitting shaft" and the "motor output shaft", respectively, according to this invention.

The electromagnetic clutch 134 serves to transmit torque or interrupt torque transmission between the driving motor 111 and the hammer bit 119 or between the output shaft 111*a* and the second intermediate shaft 136. Specifically, the electromagnetic clutch 134 is disposed on the first intermediate shaft 133 and serves to prevent the body 103 from being swung when the hammer bit 119 is unintentionally locked and reaction torque acting on the body 103 excessively increases. The electromagnetic clutch 134 is disposed above the first intermediate gear 132 in the axial direction of the first intermediate shaft 133 and located closer to the axis of motion (axis of striking movement) of the striker 143 than the first intermediate gear 132. The electromagnetic clutch 134 is a feature that corresponds to the "clutch" according to this invention. Specifically, the power transmitting mechanism 117 for rotationally driving the hammer bit 119 is constructed to transmit torque of the driving motor 111 or interrupt the torque transmission via the electromagnetic clutch 134.

Figure 4:
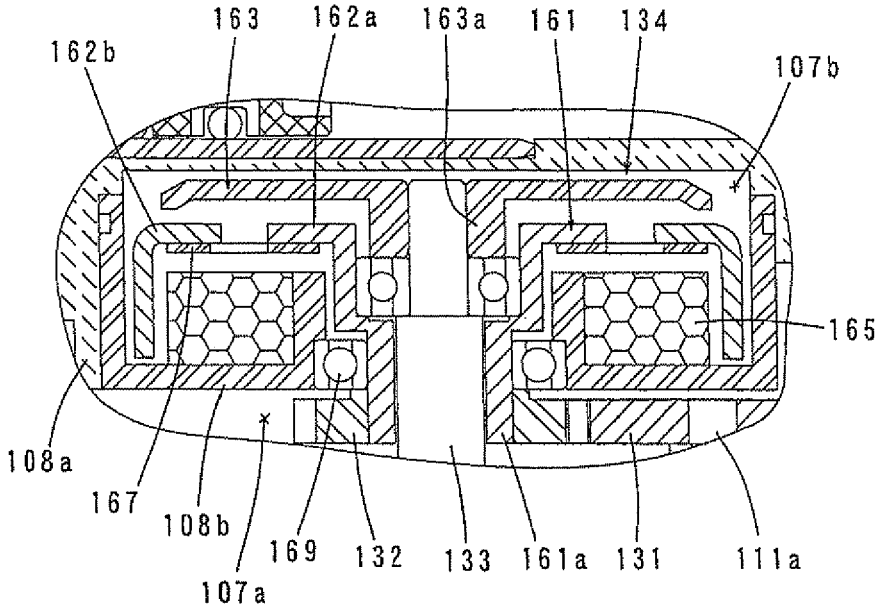
FIG. 4 is an enlarged sectional view showing the clutch in the torque transmission interrupted state.
Figure 5:
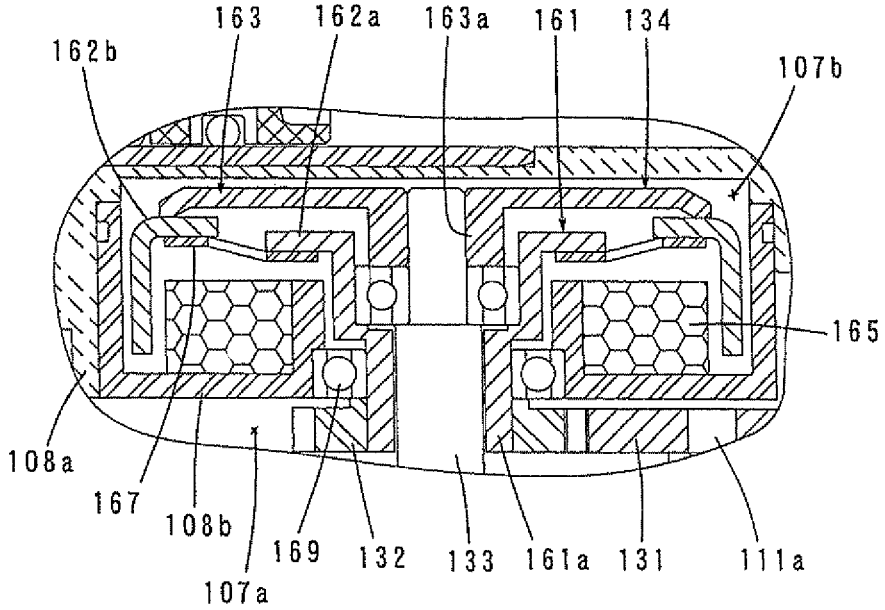
FIG. 5 is an enlarged sectional view showing the clutch in the torque transmission state.

As shown in FIGS. 4 and 5, the electromagnetic clutch 134 mainly includes a circular cup-shaped driving-side rotating member 161 and a disc-like driven-side rotating member 163 which are opposed to each other in their axial direction, a biasing member in the form of a spring disc 167 which constantly biases the driving-side rotating member 161 in a direction that releases engagement (frictional contact) between the driving-side rotating member 161 and the driven-side rotating member 163, and an electromagnetic coil 165 that engages the driving-side rotating member 161 with the driven-side rotating member 163 when it is energized. The driving-side rotating member 161 and the driven-side rotating member 163 are features that correspond to the "driving-side clutch part" and the "driven-side clutch part", respectively, according to this invention.

The driving-side rotating member 161 has a shaft (boss) 161*a* protruding downward. The shaft 161*a* is fitted onto the first intermediate shaft 133 and can rotate around its axis with respect to the first intermediate shaft 133. Further, the first intermediate gear 132 is fixedly mounted on the shaft 161*a*. Therefore, the driving-side rotating member 161 and the first intermediate gear 132 rotate together. The driven-side rotating member 163 also has a shaft (boss) 163*a* protruding downward and the shaft 163*a* is integrally fixed on one axial end (upper end) of the first intermediate shaft 133. Thus, the driven-side rotating member 163 can rotate with respect to the driving-side rotating member 161. When the first intermediate shaft 133 integrated with the shaft 163*a* of the driven-side rotating member 163 is viewed as part of the shaft 163*a*, the shaft 163*a* and the shaft 161*a* of the driving-side rotating member 161 are coaxially disposed radially inward and outward. Specifically, the shaft 163*a* of the driven-side rotating member 163 is disposed radially inward, and the shaft 161*a* of the driving-side rotating member 161 is disposed radially inward. The shaft 161*a* of the driving-side rotating member 161 is a feature that corresponds to the "driving-side clutch shaft" and the shaft 163*a* of the driven-side rotating member 163 and the first intermediate shaft 133 are features that correspond to the "driven-side clutch shaft" according to this invention.

Further, the driving-side rotating member 161 is divided into a radially inner region 162*a* and a radially outer region 162*b*, and the inner and outer regions 162*a*, 162*b* are connected by the spring disc 167 and can move in the axial direction with respect to each other. The outer region 162*b* is provided and configured as a movable member which comes into frictional contact with the driven-side rotating member 163. In the electromagnetic clutch 134 having the above-described construction, the outer region 162*b* of the driving-side rotating member 161 is displaced in the axial direction by energization or de-energization of the electromagnetic coil 165 based on a command from a controller 157. Torque is transmitted to the driven-side rotating member 163 when the electromagnetic clutch 134 comes into engagement (frictional contact) with the driven-side rotating member 163 (see FIG. 5), while the torque transmission is interrupted when this engagement is released (see FIG. 4).

Further, as shown in FIG. 3, the second intermediate gear 135 is fixed on the other axial end (lower end) of the first intermediate shaft 133, and torque of the second intermediate gear 135 is transmitted to the second intermediate shaft 136 via the mechanical torque limiter 147. The mechanical torque limiter 147 is provided as a safety device against overload on the hammer bit 119 and interrupts torque transmission to the hammer bit 119 when excessive torque exceeding a set value (hereinafter also referred to as a maximum transmission torque value) acts upon the hammer bit 119. The mechanical torque limiter 147 is coaxially mounted on the second intermediate shaft 136.

The mechanical torque limiter 147 includes a driving-side member 148 having a third intermediate gear 148*a* which is engaged with the second intermediate gear 135, and a hollow driven-side member 149 which is loosely fitted on the second intermediate shaft 136. Further, in one axial end region (lower end region as viewed in FIG. 3) of the driven-side member 149, teeth 149*a* and 136*a* formed in the driven-side member 149 and the second intermediate shaft 136 are engaged with each other. With such a construction, the mechanical torque limiter 147 and the second intermediate shaft 136 are caused to rotate together. The speed ratio of the third intermediate gear 148*a* of the driving-side member 148 to the second intermediate gear 135 is set such that the third intermediate gear 148*a* rotates at a reduced speed compared with the second intermediate gear 135. Although not particularly shown, when the torque acting on the second intermediate shaft 136 (which corresponds to the torque acting on the hammer bit 119) is lower than or equal to the maximum transmission torque value which is preset by a spring 147*a*, torque is transmitted between the driving-side member 148 and the driven-side member 149. However, when the torque acting on the second intermediate shaft 136 exceeds the maximum transmission torque value, torque transmission between the driving-side member 148 and the driven-side member 149 is interrupted.

Further, torque transmitted to the second intermediate shaft 136 is transmitted at a reduced rotation speed from a small bevel gear 138 which is integrally formed with the second intermediate shaft 136, to a large bevel gear 139 which is rotated in a vertical plane in engagement with the small bevel gear 138. Moreover, torque of the large bevel gear 139 is transmitted to the hammer bit 119 via a final output shaft in the form of the tool holder 137 which is connected to the large bevel gear 139.

In the motion converting mechanism 113 and the power transmitting mechanism 117, gears which need lubricating are housed within a closed gear housing space 107*a* of the gear housing 107 in which a lubricant is sealed. The gear housing space 107*a* is a feature that corresponds to the "gear chamber" according to this invention. In this embodiment, by provision for the electromagnetic clutch 134 that transmits torque by frictional contact between the driving-side rotating member 161 and the driven-side rotating member 163, slippage may be caused if the lubricant adheres to the clutch face.

Therefore, in this embodiment, a clutch housing space 107*b* separated from the gear housing space 107*a* is provided within the gear housing 107, and the electromagnetic clutch 134 is housed within the clutch housing space 107*b* such that it is isolated from the gear housing space 107*a*. As shown in FIGS. 4 and 5, the clutch housing space 107*b* is defined by a generally inverted cup-shaped inner housing 108*a* and integrally formed with the gear housing 107 therein, and a covering member 108*b* press-fitted into an opening of the inner housing 108*a* from below. The first intermediate shaft 133 and the shaft 161*a* of the driving-side rotating member 161 extend downward (into the gear housing space 107*a*) through the center of the covering member 108*b*. Due to this construction, a clearance is formed between the outer surface of the shaft 161*a* and the inner circumferential surface of the covering member 108*b*. The clearance is however closed by a bearing 169 disposed between the outer surface of the shaft 161*a* and the inner circumferential surface of the covering member 108*b*. Specifically, the bearing 169 is utilized as a sealing member and prevents the lubricant from entering the clutch housing space 107*b*.

Further, as shown in FIG. 3, a non-contact magnetostrictive torque sensor 151 is installed in the power transmitting mechanism 117 and serves to detect torque acting on the hammer bit 119 during operation. The magnetostrictive torque sensor 151 serves to measure torque acting on the driven-side member 149 of the mechanical torque limiter 147 in the power transmitting mechanism 117. The magnetostrictive torque sensor 151 has an exciting coil 153 and a detecting coil 155 around an inclined groove formed in an outer circumferential surface of a torque detecting shaft in the form of the driven-side member 149. In order to measure the torque, the magnetostrictive torque sensor 151 detects change in magnetic permeability of the inclined groove of the driven-side member 149 as a voltage change by the detecting coil 155 when the driven-side member 149 is turned.

A torque value measured by the magnetostrictive torque sensor 151 is outputted to the controller 157. When the torque value outputted from the magnetostrictive torque sensor 151 exceeds a predetermined torque setting, the controller 157 outputs a de-energization command to the electromagnetic coil 165 of the electromagnetic clutch 134 to disengage the electromagnetic clutch 134. Further, as for the torque setting at which the controller 157 executes disengagement of the electromagnetic clutch 134, a user can arbitrarily change (adjust) the torque setting by externally manually operating a torque adjusting means (for example, a dial), which is not shown. The torque setting adjusted by the torque adjusting means is limited to within a range lower than the maximum transmission torque value set by the spring 147*a* of the mechanical torque limiter 147. The controller 157 forms a clutch controlling device.

Further, in this embodiment, the electromagnetic clutch 134 provided for preventing excessive reaction torque from acting on the body 103 also serves as a clutch for switching between operation modes, or between hammer drill mode in which the hammer bit 119 is caused to perform striking movement and rotation and hammer mode in which the hammer bit 119 is caused to perform only striking movement, which is explained below in further detail.

As shown in FIGS. 1 and 2, an operation mode switching member in the form of an operation mode switching lever 171 is disposed in an upper surface region of the body 103. The operation mode switching lever 171 is a disc-like member having an operation tab, and mounted to the body 103 such that it can rotate around its vertical axis perpendicular to the axis of the hammer bit 119, so that it can be turned 360 degrees in a horizontal plane. A position sensor 173 for detecting operation mode is provided in the body 103. When the position sensor 173 detects the position of the operation mode switching lever 171, or specifically a part to be detected 175 which is provided in the operation mode switching lever 171, its detection signal is inputted to the controller 157.

The controller 157 outputs an energization command to the electromagnetic coil 165 of the electromagnetic clutch 134 when the position sensor 173 detects the part to be detected 175 and its detection signal is inputted to the controller 157, while the controller 157 outputs a de-energization command to the electromagnetic coil 165 when the position sensor 173 does not detect the part to be detected 175. In this embodiment, the position sensor 173 detects the part to be detected 175 only when the user selects hammer drill mode by turning the operation mode switching lever 171 and does not otherwise detect it.

The electric hammer drill 101 according to this embodiment is constructed as described above. Operation and usage of the hammer drill 101 is now explained. When the user turns the operation mode switching lever 171 to the hammer mode position (as shown in FIG. 1, an arrow marked on the operation mode switching lever 171 is aligned with a hammer mode mark M1 marked on the body 103), the position sensor 173 does not detect the part to be detected 175 in the operation mode switching lever 171. At this time, the electromagnetic coil 165 of the electromagnetic clutch 134 is de-energized by a de-energization command from the controller 157. Thus, an electromagnetic force is no longer generated, so that the outer region 162*b* of the driving-side rotating member 161 is separated from the driven-side rotating member 163 by the biasing force of the spring disc 167. Specifically, the electromagnetic clutch 134 is switched to the torque transmission interrupted state (see FIGS. 1 and 4).

In this state, when the trigger 109 is depressed in order to drive the driving motor 111, the piston 129 is caused to rectilinearly slide along the cylinder 141 via the motion converting mechanism 113. By this sliding movement, the striker 143 is caused to rectilinearly move within the cylinder 141 via air pressure fluctuations or air spring action in the air chamber 141*a* of the cylinder 141. The striker 143 then collides with the impact bolt 145, so that the kinetic energy caused by this collision is transmitted to the hammer bit 119. Specifically, when the hammer mode is selected, the hammer bit 119 performs hammering movement in the axial direction so that a hammering (chipping) operation is performed on a workpiece.

When the operation mode switching lever 171 is turned to the hammer drill mode position (as shown in FIG. 2, the arrow on the operation mode switching lever 171 is aligned with a hammer drill mode mark M2), the position sensor 173 detects the part to be detected 175 in the operation mode switching lever 171. At this time, the electromagnetic coil 165 is energized by an energization command from the controller 157, and an electromagnetic force is generated so that the outer region 162*b* of the driving-side rotating member 161 is pressed onto the driven-side rotating member 163 against the biasing force of the spring disc 167. Specifically, the electromagnetic clutch 134 is switched to the torque transmission state (see FIGS. 2 and 5).

In this state, when the trigger 109 is depressed in order to drive the driving motor 111, the rotating output of the driving motor 111 is transmitted to the tool holder 137 via the power transmitting mechanism 117. Thus, the hammer bit 119 held by the tool holder 137 is rotated around its axis. Specifically, when the hammer drill mode is selected, the hammer bit 119 performs hammering movement in its axial direction and drilling movement in its circumferential direction, so that a hammer drill operation (drilling operation) is performed on a workpiece.

During the above-described hammer drill operation, the magnetostrictive torque sensor 151 measures the torque acting on the driven-side member 149 of the mechanical torque limiter 147 and outputs it to the controller 157. When the hammer bit 119 is unintentionally locked for any cause and the measured torque value inputted from the magnetostrictive torque sensor 151 to the controller 157 exceeds the torque setting preset by the user, the controller 157 outputs a command of de-energization of the electromagnetic coil 165 to disengage the electromagnetic clutch 134. Therefore, the electromagnetic coil 165 is de-energized and thus the electromagnetic force is no longer generated, so that the outer region 162*b* of the driving-side rotating member 161 is separated from the driven-side rotating member 163 by the biasing force of the spring disc 167. Specifically, the electromagnetic clutch 134 is switched from the torque transmission state to the torque transmission interrupted state, so that the torque transmission from the driving motor 111 to the hammer bit 119 is interrupted. Thus, the body 103 can be prevented from being swung by excessive reaction torque acting on the body 103 due to locking of the hammer bit 119. The above-described torque setting is a feature that corresponds to the "predetermined torque" according to this invention.

As described above, in this embodiment, as for the structure of transmitting torque of the driving motor 111, the electromagnetic clutch 134 is disposed in a rotary drive path of the hammer bit 119. Thus, the impact driving structure is configured to be directly connected to the driving motor and only rotation is transmitted via the electromagnetic clutch 134. Therefore, compared with a construction in which a clutch is disposed to transmit torque of the driving motor 111 to both the impact drive line and the rotation drive line, torque acting on the electromagnetic clutch 134 is reduced, so that the electromagnetic clutch 134 can be reduced in size and weight. Further, according to this embodiment, the first intermediate shaft 133 is specifically designed for mounting a clutch and the electromagnetic clutch 134 is provided on the first intermediate shaft 133. With this construction, the electromagnetic clutch 134 can be provided in a high-speed low-torque region located at a stage prior to reduction of rotation speed of the driving motor 111 (the output shaft 111*a*). Therefore, the degree of freedom in designing the electromagnetic clutch 134 increases, so that further size reduction can be realized.

Further, according to this embodiment, in the electromagnetic clutch 134, the shaft 161*a* of the driving-side rotating member 161 is rotatably fitted onto the first intermediate shaft 133 on which the shaft 163*a* of the driven-side rotating member 163 is fixed. Specifically, the first intermediate shaft 133, the shaft 161*a* of the driving-side rotating member 161 and the shaft 163*a* of the driven-side rotating member 163 form a clutch shaft of the electromagnetic clutch 134, and the driving-side member and the driven-side member are coaxially disposed radially inward and outward. With this construction, the clutch faces (power transmitting faces) of the electromagnetic clutch 134 can be provided on the same shaft end (upper end) region. Specifically, input and output can be made on the same shaft end region, so that the electromagnetic clutch 134 can be disposed closer to the axis of motion (axis of striking movement) of the striker 143. As a result, moment (vibration) which is caused in the striking direction around the center of gravity in the body 103 during operation can be reduced, and the electromagnetic clutch 134 can be reduced in size in its axial direction.

Further, in this embodiment, the electromagnetic clutch 134 is disposed above the power transmitting region in which torque is transmitted between the first intermediate shaft 133 and the second intermediate shaft 136, or the engagement region in which the second intermediate gear 135 is engaged with the third intermediate gear 148*a* of the driving-side member 148 of the mechanical torque limiter 147. With this construction, the electromagnetic clutch 134 can be disposed further closer to the axis of motion (axis of striking movement) of the striker 143, which is more advantageous in reducing moment (vibration) in the striking direction.

Further, in this embodiment, the clutch housing space 107*b* separated from the gear housing space 107*a* is provided within the gear housing 107, and the electromagnetic clutch 134 is housed within the clutch housing space 107*b* such that it is isolated from the gear housing space 107*a*. Therefore, the electromagnetic clutch 134 has no risk of slippage by contact of its clutch face with the lubricant, so that a friction clutch having a high reaction rate can be used as the electromagnetic clutch 134. Further, in this embodiment, by provision of the construction in which the electromagnetic clutch 134 is switched between the torque transmission state and the torque transmission interrupted state by displacement of part (only the outer region 162*b*) of the driving-side rotating member 161 in its axial direction, the movable part can be reduced so that the clutch can be made easier to design.

Further, in this embodiment, the electromagnetic clutch 134 provided for preventing excessive reaction torque from acting on the body 103 also serves as a clutch for switching between operation modes, or between hammer mode in which the hammer bit 119 is caused to perform only striking movement and hammer drill mode in which the hammer bit 119 is caused to perform striking movement and rotation. With this construction, a rational design for preventing excessive reaction torque from acting on the body 103 and switching between operation modes can be realized.

Second Embodiment

Figure 6:
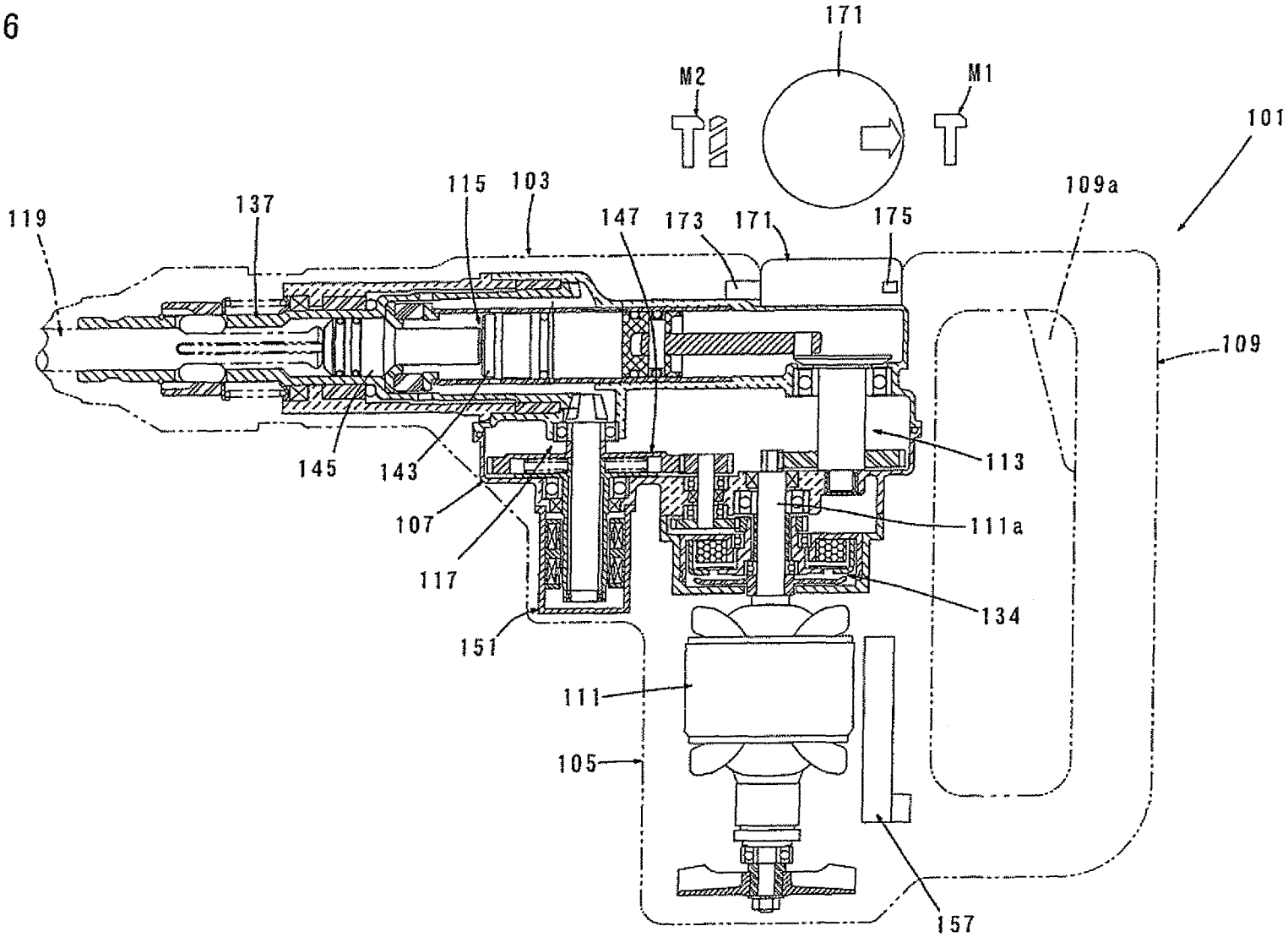
FIG. 6 is a sectional side view showing an entire structure of a hammer drill according to a second embodiment of the present invention.

A second embodiment of the present invention is now described with reference to FIGS. 6 and 7. This embodiment is a modification to the arrangement of the electromagnetic clutch 134 and corresponds to claim 2 of the invention. In this embodiment, the electromagnetic clutch 134 is disposed on the output shaft 111*a* of the driving motor 111.

Figure 7:
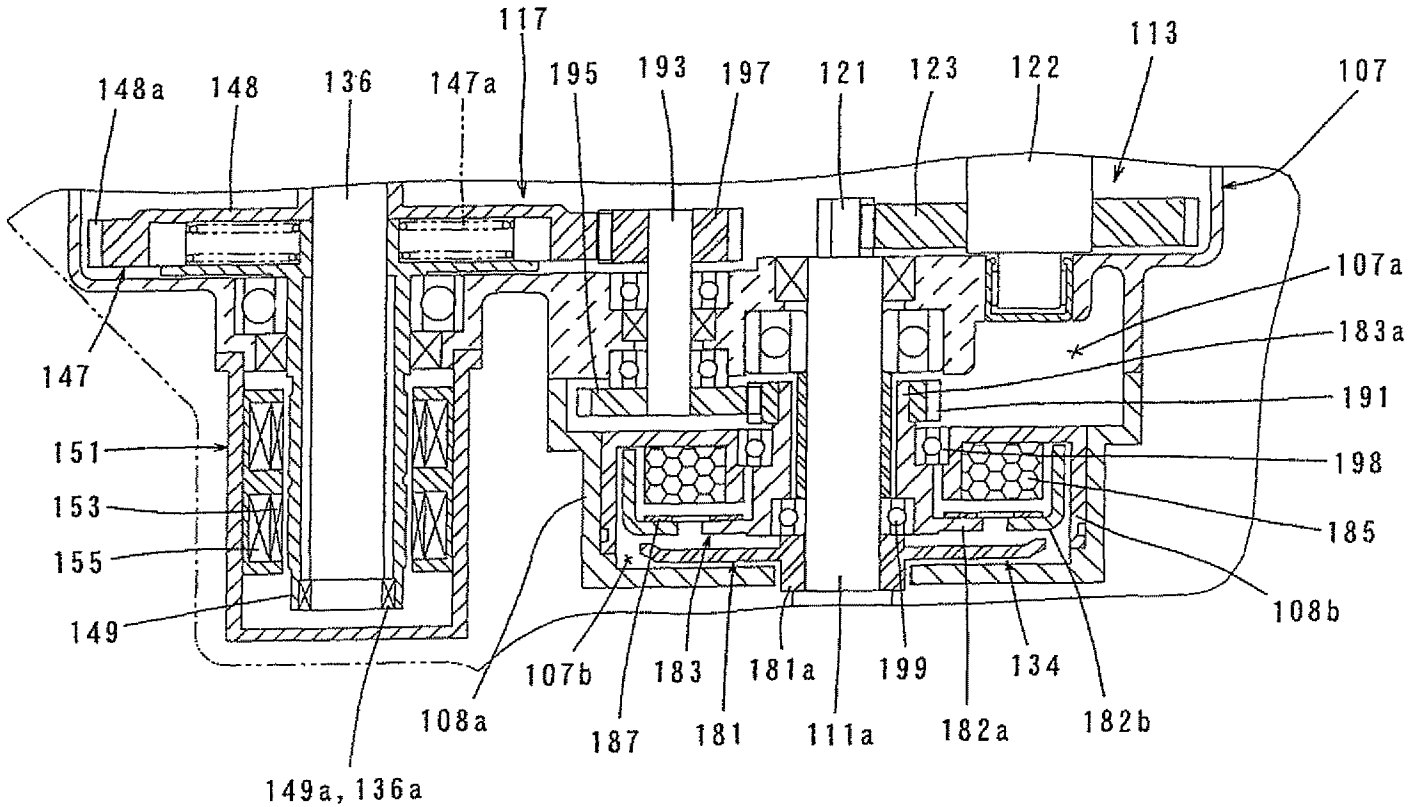
FIG. 7 is an enlarged sectional view showing an essential part of the hammer drill according to the second embodiment.

As shown in FIG. 7, the electromagnetic clutch 134 includes a driving-side rotating member 181 and a driven-side rotating member 183 which are opposed to each other in its axial direction. A shaft (boss) 181*a* of the driving-side rotating member 181 is integrally fixed on the output shaft 111*a*, and a shaft (boss) 183*a* of the driven-side rotating member 183 is rotatably fitted onto the output shaft 111*a*. Further, the driven-side rotating member 183 is disposed above the driving-side rotating member 181.

The driven-side rotating member 183 is divided into a radially inner region 182*a* and a radially outer region 182*b*, and the inner and outer regions 182*a*, 182*b* are connected by a spring disc 187 and can move in the axial direction with respect to each other. The outer region 182*b* is provided and configured as a member which comes into engagement (frictional contact) with the driving-side rotating member 181. Specifically, in this embodiment, the outer region 182*b* of the driven-side rotating member 183 is displaced in the axial direction via the spring disc 187. When an electromagnetic coil 185 is de-energized, the outer region 182*b* is biased by the spring disc 187 such that it is separated from the driving-side rotating member 181, and when the electromagnetic coil 185 is energized, the outer region 182*b* comes into engagement (frictional contact) with the driving-side rotating member 181 by the electromagnetic force.

The first driving gear 121 is formed on the upper end of the output shaft 111*a* and engaged with the driven gear 123 of the crank mechanism which forms the motion converting mechanism 113. Specifically, the motion converting mechanism 113 and the striking mechanism 115 for driving the hammer bit 119 by impact are directly connected to the driving motor 111. In this point, this embodiment is similar to the first embodiment. The motion converting mechanism 113 and the striking mechanism 115 are features that correspond to the "impact drive mechanism", and the output shaft 111*a* is a feature that corresponds to the "impact drive shaft" according to this invention.

The shaft 183*a* of the driven-side rotating member 183 extends upward and a second driving gear 191 is fixed on the extending end of the shaft 183*a*. Further, a first intermediate shaft 193 is disposed between the output shaft 111*a* and the second intermediate shaft 136 of the power transmitting mechanism 117 which is disposed side by side in parallel to the output shaft 111*a* and in parallel to the shafts 111*a*, 136. A first intermediate gear 195 is fixed on one axial end (lower end) of the first intermediate shaft 193 and engaged with the second driving gear 191, and a second intermediate gear 197 is fixed on the other axial end (upper end) of the first intermediate shaft 193. The second intermediate gear 197 is engaged with the third intermediate gear 148*a* of the driving-side member 148 of the mechanical torque limiter 147 provided on the second intermediate shaft 136. The electromagnetic clutch 134 disposed on the output shaft 111*a* of the driving motor 111 transmits torque or interrupt torque transmission between the output shaft 111*a* and the first intermediate shaft 193. Specifically, the power transmitting mechanism 117 for rotationally driving the hammer bit 119 is constructed to transmit torque of the driving motor 111 or interrupt the torque transmission via the electromagnetic clutch 134. The power transmitting mechanism 117 is a feature that corresponds to the "rotary drive mechanism" according to this invention. Further, the shaft 181*a* of the driving-side rotating member 181 and the shaft 183*a* of the driven-side rotating member 183 form a clutch shaft, and the clutch shaft is a feature that corresponds to the "rotary drive shaft" according to this invention.

Further, the electromagnetic clutch 134 is housed within the clutch housing space 107*b* of the gear housing 107 so that it is isolated from the gear housing space 107*a*. The clutch housing space 107*b* is defined by the inner housing 108*a* formed (fixed separately) on the gear housing 107 and the covering member 108*b* which serves as a partition to separate the inner space of the inner housing 108*a* from the gear housing space 107*a*.

In the electromagnetic clutch 134, the shaft 183*a* of the driven-side rotating member 183 extends from the clutch housing space 107*b* into the gear housing space 107*a*. Due to this construction, clearances are formed between the outer circumferential surface of the shaft 183*a* and the inner circumferential surface of the covering member 108*b* and between the inner circumferential surface of the shaft 183*a* and the outer circumferential surface of the output shaft 111*a*. The clearances are however closed by a bearing 198 disposed between the outer circumferential surface of the shaft 183*a* and the inner circumferential surface of the covering member 108*b* and a bearing 199 disposed between the inner circumferential surface of the shaft 183*a* and the outer circumferential surface of the output shaft 111*a*. Specifically, the bearings 198, 199 are utilized as a sealing member and prevent the lubricant from entering the clutch housing space 107*b*.

In the other points, including the structure for engagement and disengagement (torque transmission and interruption) of the electromagnetic clutch 134 based on measurements of torque by the magnetostrictive torque sensor 151, and the structure for engagement and disengagement of the electromagnetic clutch 134 based on switching operation of the operation mode switching lever 171, this embodiment has the same construction as the above-described first embodiment. Therefore, components in this embodiment which are substantially identical to those in the first embodiment are given like numerals as in the first embodiment, and they are not described.

According to this embodiment, as for driving of the hammer bit 119, the impact driving structure is configured to be directly connected to the driving motor and only rotation is transmitted via the electromagnetic clutch 134. Further, the electromagnetic clutch 134 is disposed on the output shaft 111*a* of the driving motor 111 which is driven at high speed and low torque. With this construction, torque acting on the electromagnetic clutch 134 is reduced, so that the electromagnetic clutch 134 can be reduced in size and weight.

Further, according to this embodiment, with the construction in which the clutch shaft is coaxially disposed radially outward of the output shaft 111*a*, the electromagnetic clutch 134 disposed on the output shaft 111*a* can be reduced in size in its axial direction, so that rational space-saving arrangement can be realized. Further, in this embodiment, with the construction in which the electromagnetic clutch 134 is isolated from the gear housing space 107*a* such that the lubricant is avoided from adhering to it, like in the first embodiment, the electromagnetic clutch 134 has no risk of slippage by contact of its clutch face with the lubricant, so that a friction clutch having a high reaction rate can be used as the electromagnetic clutch 134.

Further, this embodiment has the same effects as the above-described first embodiment. For example, when the hammer bit 119 is unintentionally locked during hammer drill operation, the electromagnetic clutch 134 is switched from the torque transmission state to the torque transmission interrupted state, so that the body 103 can be prevented from being swung by a reaction torque acting on the body 103. Further, the electromagnetic clutch 134 provided for preventing excessive reaction torque from acting on the body 103 also serves as a clutch for switching between operation modes.

Further, in this embodiment, the magnetostrictive torque sensor 151 is used as a means for detecting reaction torque acting on the body 103, but such means is not limited to this. For example, it may be constructed such that movement of the body 103 is measured by a speed sensor or an acceleration sensor and the reaction torque on the body 103 is detected from the measurements.

In view of the scope and spirit of the above-described invention, the following features can be provided.

(1)

"The impact tool as defined in claim 1, wherein the path of transmitting torque of the motor to the tool bit includes an impact drive line for rectilinearly driving the tool bit in the axial direction and a rotation drive line for rotationally driving the tool bit around the axis, and the clutch is disposed in the rotation drive line."

(2)

"The impact tool as defined in any one of claims 1 to 10, comprising a non-contact torque sensor that detects torque acting on the tool bit during operation in non-contact with a rotating shaft that rotates together with the tool bit, wherein torque transmission by the clutch is interrupted when the torque value detected by the torque sensor exceeds a torque setting."

(3)

"The impact tool as defined in (2), comprising a torque adjusting member that can be manually operated to adjust the torque setting which is set by the torque sensor."

(4)

"The impact tool as defined in any one of claims 1 to 10, comprising a speed sensor or an acceleration sensor that measures momentum of the tool body and detects reaction torque acting on the tool body from the measurement."

(5)

"The impact tool as defined in any one of claim 1 to 10 or (1), wherein the clutch includes a driving-side clutch part and a driven-side clutch part, and one of the driving-side clutch part and the driven-side clutch part has a radially inner region and a radially outer region and comes into engagement with or disengagement from the other clutch part by displacement of the outer region with respect to the inner region."

(6)

"The impact tool as defined in claim 2, wherein the speed ratio between the motor output shaft and the clutch shaft is substantially the same."

(7)

"The impact tool as defined in claim 9, comprising a clutch housing space that houses the clutch isolated from the gear chamber, and a bearing which rotatably supports a shaft of the clutch and forms a sealing member that prevents the lubricant of the gear chamber from entering the clutch housing space."

DESCRIPTION OF NUMERALS

101 hammer drill (impact tool)
103 body (tool body)
105 motor housing
107 gear housing
107*a* gear housing space (gear chamber)
107*b* clutch housing space
108*a* inner housing
108*b* covering member
109 handgrip

109*a* trigger
111 driving motor (motor)
111*a* output shaft (motor output shaft, impact drive shaft)
113 motion converting mechanism (impact drive mechanism)
115 striking mechanism (impact drive mechanism)
117 power transmitting mechanism (rotary drive mechanism)
119 hammer bit (tool bit)
121 first driving gear
122 crank shaft
123 driven gear
125 crank plate
126 eccentric shaft
127 crank arm
128 connecting shaft
129 piston
131 second driving gear
132 first intermediate gear
133 first intermediate shaft
134 electromagnetic clutch (clutch)
135 second intermediate gear
136 second intermediate shaft
136*a* teeth
137 tool holder
138 small bevel gear
139 large bevel gear
141 cylinder
141*a* air chamber
143 striker (striking element)
145 impact bolt (intermediate element)
147 mechanical torque limiter
147*a* spring
148 driving-side member
148*a* third intermediate gear
149 driven-side member
149*a* teeth
151 magnetostrictive torque sensor
153 exciting coil
155 detecting coil
157 controller
161 driving-side rotating member (driving-side clutch part)
161*a* shaft (driving-side clutch shaft)
162*a* radially inner region
162*b* radially outer region
163 driven-side rotating member (driven-side clutch part)
163*a* shaft (driven-side clutch shaft)
165 electromagnetic coil
167 spring disc
169 bearing
171 operation mode switching lever
173 position sensor
175 part to be detected
181 driving-side rotating member
181*a* shaft (clutch shaft)
182*a* radially inner region
182*b* radially outer region
183 driven-side rotating member
183*a* shaft (clutch shaft, rotary drive shaft)
185 electromagnetic coil
187 spring disc
191 second driving gear
193 first intermediate shaft
195 first intermediate gear
197 second intermediate gear
198 bearing
199 bearing

I claim:

1. An impact tool, which causes a tool bit to perform striking movement in an axial direction of the tool bit and rotation around an axis of the tool bit, thereby causing the tool bit to perform a predetermined operation on a workpiece, comprising:

a tool body, a motor that is housed in the tool body and drives the tool bit, an impact drive mechanism configured to drive the tool bit by impact, a rotary drive mechanism configured to rotationally drive the tool bit, an impact drive shaft that is rotationally driven by the motor and drives the impact drive mechanism, and a rotary drive shaft that is rotationally driven independently of the impact drive shaft by the motor and drives the rotary drive mechanism, and a clutch that is disposed upstream of the rotary drive mechanism in a path of transmitting torque of the motor to the tool bit, and transmits torque of the motor to the rotary drive mechanism, while interrupting the torque transmission when the torque acting on the tool body around an axis of the tool bit exceeds a predetermined torque, wherein the impact drive shaft and the rotary drive shaft are coaxially disposed, and the clutch is disposed on the rotary drive shaft.

2. The impact tool as defined in claim 1, wherein the impact drive shaft and the rotary drive shaft are coaxially disposed such that the impact drive shaft is located radially inward and the rotary drive shaft is located radially outward.

* * * * *